US007134662B2

(12) United States Patent
Menendez

(10) Patent No.: US 7,134,662 B2
(45) Date of Patent: Nov. 14, 2006

(54) WASHER GAME WITH AN UPRIGHT TUBE

(76) Inventor: Richard J. Menendez, 7023 Field Ave., St. Louis, MO (US) 63116

( * ) Notice: Subject to any disclaimer, the term of this patent is extended or adjusted under 35 U.S.C. 154(b) by 0 days.

(21) Appl. No.: 10/953,042

(22) Filed: Sep. 29, 2004

(65) Prior Publication Data

US 2006/0066055 A1 Mar. 30, 2006

(51) Int. Cl.
*A63B 63/00* (2006.01)

(52) U.S. Cl. ..... 273/400

(58) Field of Classification Search ..... 273/398–402
See application file for complete search history.

(56) References Cited

U.S. PATENT DOCUMENTS

| | | | | | |
|---|---|---|---|---|---|
| 1,442,054 | A | * | 1/1923 | Dixon | 273/397 |
| 3,351,344 | A | * | 11/1967 | Dupuy | 273/400 |
| 3,790,174 | A | * | 2/1974 | Skillern | 273/394 |
| 4,392,653 | A | * | 7/1983 | Blume, Sr. | 273/400 |
| 4,877,256 | A | * | 10/1989 | Falloon | 273/400 |
| 4,982,966 | A | * | 1/1991 | Teafatiller | 273/338 |
| 5,018,745 | A | * | 5/1991 | Dunse | 273/338 |
| 5,040,801 | A | * | 8/1991 | Weymuth | 273/338 |
| 5,052,693 | A | * | 10/1991 | Hicks | 273/336 |
| 5,110,139 | A | | 5/1992 | Baumgartner | |
| 5,123,656 | A | * | 6/1992 | Green | 273/400 |
| D329,666 | S | | 9/1992 | Dougherty | |
| 5,553,862 | A | | 9/1996 | Konotopsky | |
| 5,704,612 | A | * | 1/1998 | Kelly et al. | 273/402 |
| 5,882,010 | A | * | 3/1999 | Geror | 273/400 |
| 5,954,337 | A | * | 9/1999 | Cunningham | 273/338 |
| D415,533 | S | | 10/1999 | Shost, Jr. | |
| D428,061 | S | | 7/2000 | Billodeau | |
| 6,161,833 | A | | 12/2000 | Gomez | |
| D479,279 | S | | 9/2003 | Kessler, Jr. | |
| 6,669,200 | B1 | * | 12/2003 | Knetsch et al. | 273/400 |
| 2002/0175469 | A1 | | 11/2002 | Kessler, Jr. | |

* cited by examiner

*Primary Examiner*—Mark S. Graham
(74) *Attorney, Agent, or Firm*—Charles C. McCloskey

(57) ABSTRACT

A washer game with an upright tube has two targets spaced apart to test people's skill at throwing washers. The targets are round with concentric rings upon a flat base within a perimeter wall. Score value increases as ring diameter decreases. The centermost ring has a diameter to receive an upright tube. The upright tube extends perpendicular to the target and may have arms branching off the upright tube. In addition to the targets and tubes, the game has a plurality of washers or bean bags. Players of the game can add or remove the tubes to vary the difficulty of the game.

6 Claims, 4 Drawing Sheets

WASHER GAME WITH AN UPRIGHT TUBE

BACKGROUND OF THE INVENTION

The washer game with an upright tube relates generally to games and more specifically to throwing games involving a target at a distance.

People play games for entertainment and to develop coordination. Games have rules and usually scoring to measure skill. As coordination develops, skills and scores generally improve. At machine shops, auto shops, and hardware stores, washers accumulated often. Workers and customers would toss spare washers occasionally. In the last thirty years, a game developed in throwing washers at a distant target for score akin to horseshoes thrown at picnics.

Traditionally, washer games have two spaced apart scoring boxes that receive tossed washers. The prior art boxes are typically manufactured from wood, metal, plastic and other materials in a square form with an open top. The square boxes received washers from all directions and permitted scoring of washers along a diagonal of the box similar to along the longitudinal and lateral axes of the box. The structure of the box allowed scoring at greater distances but perhaps at lesser skill. Further limitations of the prior art included scoring for only washers within the box, not precisely at the center and few features to reduce rebounding of the washers as they contacted the scoring box. This prior art limitation sometimes allowed well tossed washers to bounce out of the scoring box, thereby heightening the skill required at the game beyond mere throwing accuracy. Players would have to account for the spin and angle of impact of the washer with the box. The prior art had little recognition for a perfect center ringer toss.

Presently, people throw washers outdoors and indoors upon surfaces resistant to chipping, like concrete. The outdoor surfaces absorb impact of washers as in earth or people tolerate damage as in wooden surfaces or concrete. With washers thrown between targets, or boxes, the area proximate to the target sustains the impact from the washers. When used indoors, surfaces limit the play of the washer game to those surfaces deemed chip resistant. A target of sufficient area would protect an indoor surface while still allowing competitive scoring of games.

DESCRIPTION OF THE PRIOR ART

The prior art has many version of boxes and targets. Some boxes stack and some nest. Other boxes have scoring systems painted upon the box and rules for the players. Some boxes award higher points for washers thrown and landed in the center of the box. However, few washer boxes mention an upright target.

The patent to Blume, U.S. Pat. No. 4,392,653, shows a target apparatus for a washer game. Like the present invention, the apparatus has an upright tube and a box with a perimeter wall. However, this patent has a hole in the bottom for inserting the tube, four sides, and lacks throwing pieces and concentric rings within the perimeter wall.

The patent to Teafatiller, U.S. Pat. No. 4,982,966, shows a ring toss game apparatus with separable but locking cases. Similar to the present invention, this patent has a tube attached to the center of a case. Different from the present invention, this patent has a tube with fins on the end that secure into slots in the cases, a handle on the case, scoring pegs, and no internal concentric rings.

The patent to Weymuth, U.S. Pat. No. 5,040,801, shows a two cup washer game. Akin to the present invention, this patent has cups serving as adjacent rings. Unlike the present invention, this patent has adjacent cups as point targets in contrast to the area target of the present invention, spikes through the cups securing them to the earth, nodes or bumps on the bottom of the cups to aid in retrieval of washers, and plastic washers.

The patent to Baumgartner, U.S. Pat. No. 5,110,139, shows a disk tossing game with a box target. Like the present invention, the patent has a central ring as the final washer target. Unlike the present invention, the patent has an outer box shape, cross bars within the box and beneath the central ring, and no tube above the ring.

Then, the patent to Dougherty, U.S. Pat. No. D329,666, illustrates the design for a round game target. As the present invention does, this patent has a round target with a central cylinder or ring. However, this patent like Baumgartner's '139 patent has an open bottom, cross bars beneath the ring, and a lip upon the top of the sidewall but no upright tube.

The patent to Konotopsky, U.S. Pat. No. 5,553,862, shows a two piece tossing game. Similar to the present invention, this patent has concentric scoring rings in a bull's eye arrangement. In contrast to the present invention, this patent has a flat board propped at an angle on a support and flat scoring rings but lacks a sidewall to contain washers and an upright tube.

The patent to Shost, Jr. et al., U.S. Pat. No. D415,533, illustrates an octagonal washer target. Like the present invention, this patent has a central cup higher than the sidewalls. In contrast to the present invention, this patent has a square cup and octagon shape.

The patent to Billodeau et al., U.S. Pat. No. D428,061, illustrates another washer toss game with a central ring or cup. Like the present invention, this patent has a central cup but the cup rests upon cross bars and extends above the box. Further, the patent has a square box where the present invention has a round target.

The patent to Gomez, U.S. Pat. No. 6,161,833, shows a recent patent for another washer toss game. This patent has concentric rings for scoring. Unlike the present invention, this patent has a raised mat with a cup in the center and the cup beneath the mat.

Then, the patent to Kessler, Jr. et al. U.S. Pat. No. 6,749,201 shows a stackable washer game target with a central ring. Differing from the present invention, this patent has a tapered sidewall and a removable center pin with a base plug. The patent also has surface treatments for the washers and the bottom of the target.

The patent to Kessler, Jr. et al., No. U.S. Pat. No. D479,279, illustrates a stackable washer target. As in the present invention, this design patent has a raised center portion to receive thrown washers. However, this patent has a central pin, four tapered sides arranged in a rectangle, and nodes upon the bottom which the present invention lacks.

The patent to Knetsch et al., U.S. Pat. No. 6,669,200, has a washer game with a box. As in the present invention, this patent has a central upright tube. However, this patent has an adjustable height tube inserted through a hole in the bottom of a box, and an adjustable false bottom in a square box.

And, the patent to Geror, U.S. Pat. No. 5,882,010, has a game with rings upon a target. As in the present invention, this patent has a central cup to receive thrown washers. However, this patent lacks an upright tube above the sidewall, has the tray not in contact with the ground, and has the cup as an integral molded part of the tray.

The present invention overcomes the difficulties of cross arms and tapered central rings and allows installation of an upright tube for a new dimension to the washer tossing game.

SUMMARY OF THE INVENTION

Generally, the present invention provides a game and method of play with washers similar to the game of horseshoes played at picnics and in parks across the nation. Presently, people throw washers outdoors and indoors upon surfaces resistant to chipping, like concrete. Some washer games have square bins as the distant target from a player.

The present invention has one or more round targets and upright tubes suitable for indoor and outdoor use. The target has a round cylindrical shape closed on the bottom and open on the top to receive thrown washers. Within the target, one or more rings have concentric locations with various radii. The rings are spaced along the diameter of the target. Each ring represents a different point value for a game. Two or more people play the game, individually or on teams. Typically, each player throws four pieces, or washers, in a round. The center ring has the highest points for its small diameter in contrast to the outer ring with the lowest points for its large diameter. The center ring has a fixed diameter to receive an upright tube. The upright tube can have one or more openings that receive thrown washers. As an accessory to the game, the players choose whether to play with the upright tube. Preferably, the center ring is four and one half inches outside diameter to accept a PVC pipe fitting. In using two targets, the targets are spaced at least twenty feet apart at the players' discretion. Additionally, the targets may have scoring for washers landing within each ring, increasing towards the center and for landing within the upright tube. The players throw washers until a player or team reaches twenty one points.

There has thus been outlined, rather broadly, the more important features of the invention in order that the detailed description thereof that follows may be better understood and that the present contribution to the art may be better appreciated. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a new and improved washer game with an upright tube.

Another object is to provide such a washer game that has multiple concentric rings for scoring.

Another object is to provide such a washer game that is portable and suitable for both indoor and outdoor use.

Another object is to provide such a washer game that has an upright opening for additional scoring opportunities.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

The same reference numerals refer to the same parts throughout the various figures.

DESCRIPTION OF THE PREFERRED EMBODIMENT

Figure 1:
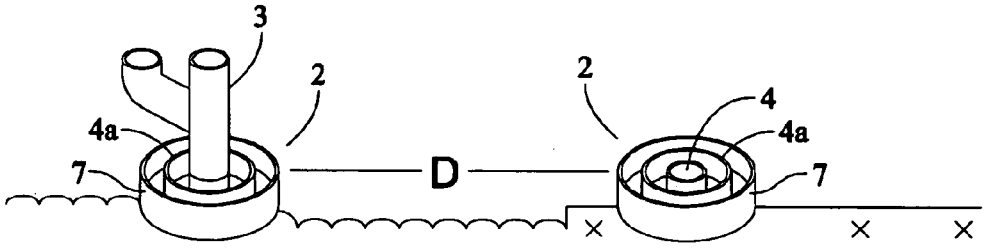
FIG. 1 shows a side view of the preferred embodiment of the washer game with an upright tube and without a tube arranged for play and constructed in accordance with the principles of the present invention.

The present art overcomes the prior art limitations by providing a target with one or more concentric rings and an upright tube accessory to receive pieces, or washers, thrown at a distance for score. Beginning on FIG. 1, a washer game of the present invention 1 has one or more targets 2 at a distance, D. Here shown are two targets 2 with one upon a solid surface, or concrete, and the other upon the ground. The concrete represents indoor use of the present invention 1 while the ground represents outdoor use. In the washer game, targets 2 have a twenty foot distance between them and the rings 4, 4*a* within a target 2 have higher score as the ring 4 diameter decreases. A suggested scoring system is one point for a washer in the outer ring 4, three points for a washer in the inner ring 4, and five points for a washer landed in the center ring 4 where a total score of twenty one points wins the game. Preferably, one or more targets 2 have an upright tube 3 for variety and to increase the challenge of the game.

Figure 2:
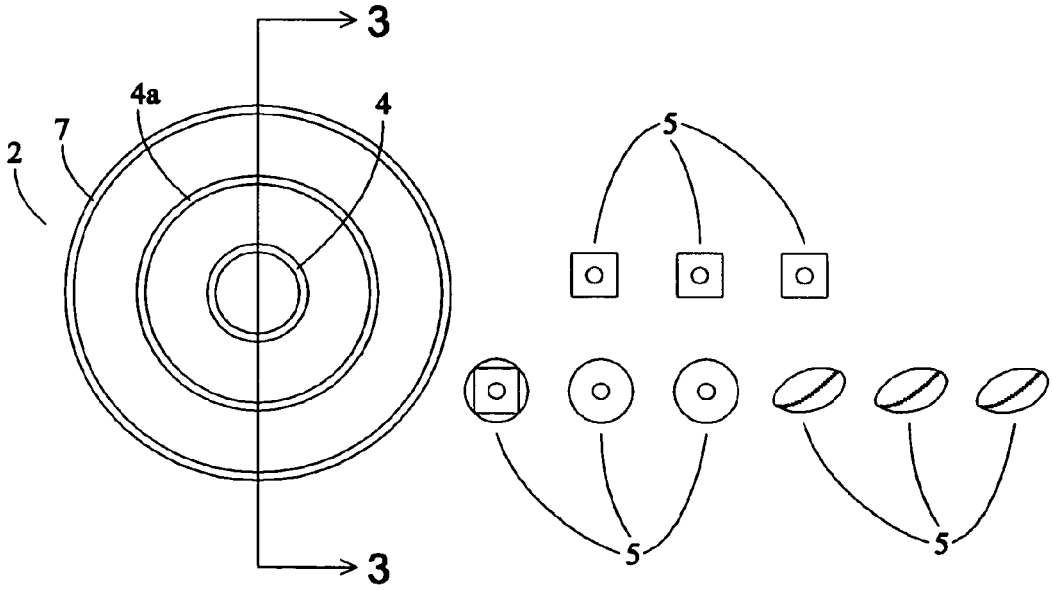
FIG. 2 shows a top view of the preferred embodiment of a target of the present invention with pieces suitable for tossing.

Then in FIG. 2, the preferred embodiment of a target 2 has a generally round shape with a central ring 4 and one or more inner rings 4*a* within a wall 7. The rings 4, 4*a* are concentric and centered upon the target 2. As ring 4 diameter decreases score value in the washer game increases. The central ring 4 has a diameter no more than one third the diameter of the target 2. Preferably, the central ring 4 has a diameter to fit an upright tube 3, approximately four and one half inches. The central ring 4 has the highest score awarded for a washer that lands within it. In addition to the target 2, the present invention 1 includes a plurality of throwing pieces, beanbags, or washers 5 either round or square in shape and less than four inches in diameter and width respectively.

Figure 3:
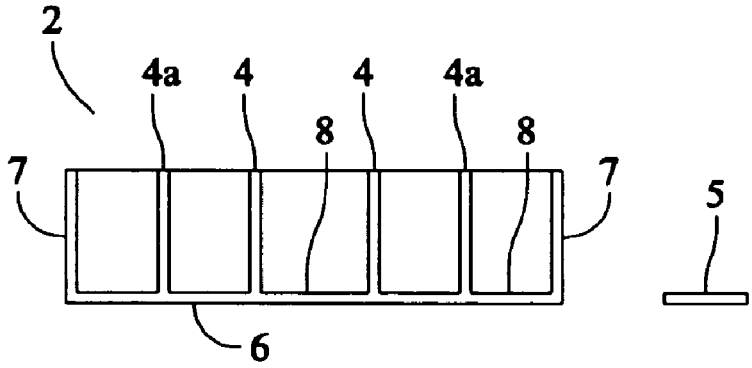
FIG. 3 shows a sectional view through the preferred embodiment of the target.

Rotating a target 2, FIG. 3 shows a target 2 having a flat base 6 generally round in plan view as in FIG. 2, a wall 7 upon the perimeter, and multiple rings 4, 4*a* upon the base 6. The wall 7 is a hollow cylinder centered upon the base 6 and joined to the top surface 8 of the base 6. Within the wall 7, the preferred embodiment has multiple rings 4, 4*a* arranged concentrically. Though many rings 4 are possible, two rings 4, 4*a* are shown here for clarity. Each ring 4, 4*a* is a hollow cylinder upon the top surface 8 of the base 6. The central ring 4 has a diameter suitable for a snug fit with an upright tube 3, here approximately four and one half inches. The multiple rings 4*a* have the same height, or less, as the wall 7. Along with the target 2, the present invention 1 has throwing pieces, or washers 5, that have a rectangular cross section with a hole in the center.

Figure 4:
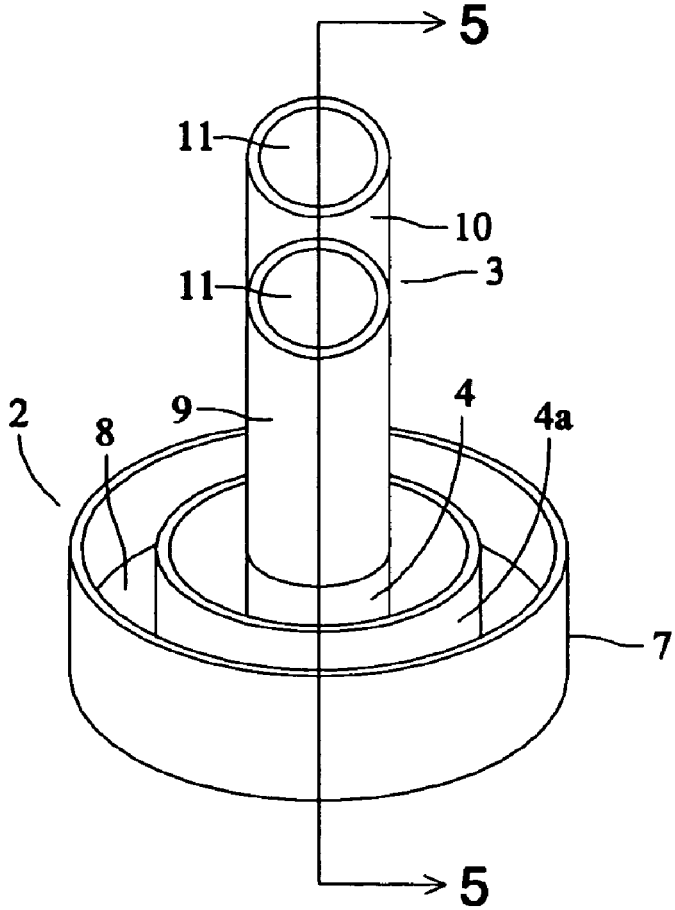
FIG. 4 illustrates a perspective view of an upright tube emplaced upon the preferred embodiment of the target.

FIG. 4 has the preferred embodiment of the target 2 with a generally round shape and an upright tube 3. As described in FIG. 1, the washer game allows use of an upright tube 3 with a vertical sleeve 9 that fits over the central ring 4 in a target 2. The vertical sleeve 9 is approximately four and one half inches in diameter. From the sleeve 9, the upright tube 3 has one or more arms 10 that branch upward and outward. Each arm 10 ends in an opening 11 to receive washers 5.

Figure 5:
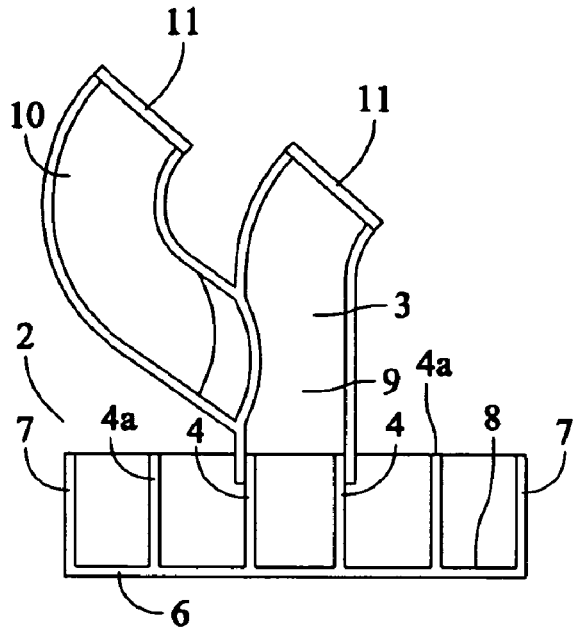
FIG. 5 illustrates a sectional view through the upright tube upon the preferred embodiment of the target.

Taking a section through FIG. 4, the present invention 1 has an upright tube 3 fitted snugly upon the central ring 4 of a target 2 in FIG. 5. The sleeve 9 extends upward where the arms 10 extend laterally from the sleeve 9. The arms 10 extend further upward, and laterally upon a radius from the center of the target 2 and then upward. The openings 11 at the ends of each arm 10 collect washers 5 thrown by the players. Within the tube 3, the washers 5 slide under gravity to the central ring 4.

Figure 6:
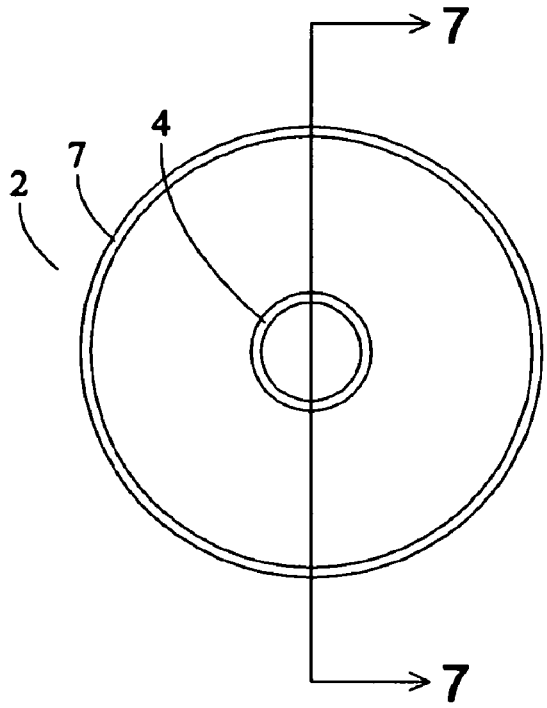
FIG. 6 describes a top view of an alternate embodiment of a target of the present invention; and, FIG. 7 describes a sectional view through the alternate embodiment of the target.

Moving to FIG. 6, the alternate embodiment of a target 2 has a base 6, generally round in shape with a wall 7 upon the perimeter. The wall 7 is a hollow cylinder centered upon the base 6 and joined to the top surface 8 of the base 6. Within the wall 7, the alternate embodiment has a central ring 4 formed from a hollow cylinder upon the top surface 8 of the base 6. The central ring 4 has a diameter no more than one third the diameter of the target 2. The central ring 4 has a diameter suitable for a snug fit with an upright tube 3 and a height similar or less than that of the wall 7. In playing the game with the alternate embodiment of the target 2, the central ring 4 has the highest score awarded for a washer that lands within it.

Figure 7:
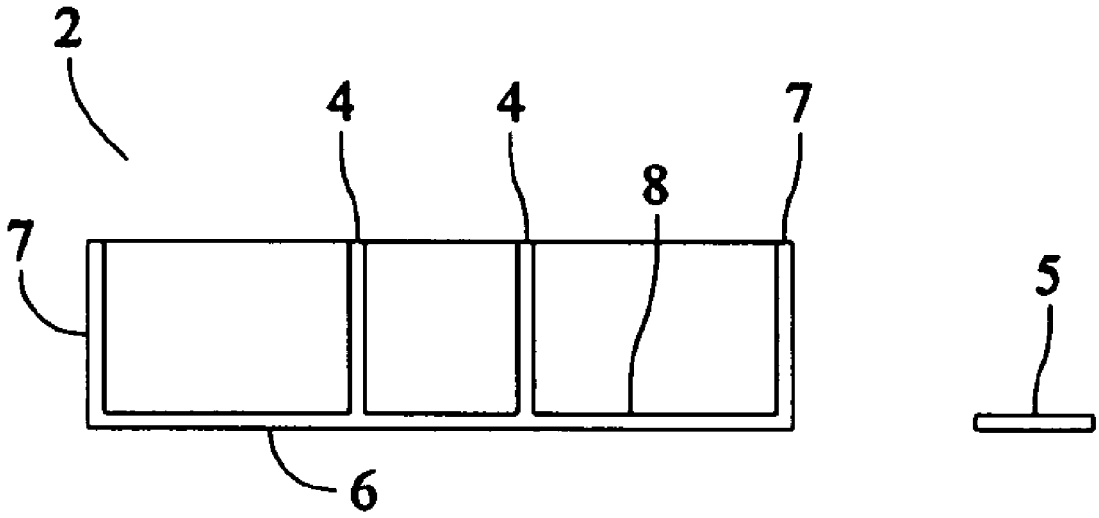

Viewing, in FIG. 7, the alternate embodiment in section, the target 2 has a flat base 6, a wall 7, and a ring 4 upon the base 6. The wall 7 is a hollow cylinder joined to the top surface 8 of the target 2 upon the perimeter of the target 2. Within the wall 7, the target 2 has a ring 4 centered upon the base 6. The central ring 4 is a hollow cylinder of the same height or less as the wall 7 and also joined to the top surface 8 of the target 2. The central ring 4 has a diameter to fit snugly with an upright tube 3. Along with the target 2, the present invention 1 has bean bags or washers 5 that typically have a rectangular cross section with a hole in the center.

From the aforementioned description, a washer game with an upright tube has been described. The washer game with an upright tube is uniquely capable of providing scoring at multiple rings with upright scoring through a tube, all upon a flat base for indoor and outdoor use. The washer game with an upright tube and its various components may be manufactured from many materials, including but not limited to, polyvinyl chloride PVC pipe and fittings such as elbows and wyes, plywood, polymers, high density polyethylene HDPE, polypropylene PP, nylon, ferrous and non-ferrous metals, their alloys, and composites.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A game for throwing both indoors and outdoors comprising:

one or more targets having a base with a top surface, a wall perpendicular to said base and proximate to the perimeter of said base, and at least one concentric ring centered upon said target within said wall and having a height no more than that of said wall, and said at least one ring and said wall join to said top surface;

at least one tube having a diameter slightly larger than that of said ring closest to the center of said target, said tubes having at least one arm extending outward from said tube and terminating in openings; and, a plurality of pieces for throwing;

whereby said openings have a score value and said concentric rings have a score value that increases as the diameter of said rings decreases;

whereby players of said game may remove or add said tubes to said targets at their discretion.

2. The throwing game of claim 1 further comprising:

said targets having a round base.

3. The throwing game of claim 1 wherein said pieces are washers, discs, or bean bags.

4. A game to test skill at throwing for indoor and outdoor use comprising:

at least one target having a round base with a top surface, a wall perpendicular to said base and proximate to the perimeter of said base, and at least one concentric ring centered upon said target within said wall and having a height no more than that of said wall;

a plurality of throwing pieces, said pieces being washers or bean bags;

a tube fit upon said ring closest to the center of said target, said tube being generally perpendicular to said base, and snug upon said ring closest to the center of said target;

at least one branch extending from said tube, generally lateral and upward from said tube; and, said branch being generally round and of a cross section similar to said tube and each of said branches terminating in an opening to receive said throwing pieces;

whereby, said rings and said wall join to said top surface.

5. The throwing game of claim 4 wherein said target has two of said rings.

6. The throwing game of claims 4 wherein said target has one of said ring.

* * * * *